US006487889B1

(12) United States Patent
Bates et al.

(10) Patent No.: US 6,487,889 B1
(45) Date of Patent: Dec. 3, 2002

(54) TUBE BENDER

(75) Inventors: Darryle E. Bates, Cuyahoga Falls, OH (US); Scott S. Kalanish, Hiram, OH (US)

(73) Assignee: Stride Tool, Inc., Ellicottville, NY (US)

( * ) Notice: Subject to any disclaimer, the term of this patent is extended or adjusted under 35 U.S.C. 154(b) by 0 days.

(21) Appl. No.: 10/004,701

(22) Filed: Dec. 4, 2001

(51) Int. Cl.[7] ..... B21B 45/02
(52) U.S. Cl. ..... 72/459
(58) Field of Search ..... 72/216, 217, 218, 72/459, 458

(56) References Cited

U.S. PATENT DOCUMENTS

| | | | | |
|---|---|---|---|---|
| 1,650,955 A | * | 11/1927 | Miller | 72/459 |
| 1,899,281 A | * | 2/1933 | Lidseen | 72/216 |
| 2,232,819 A | * | 2/1941 | Abramson et al. | 72/217 |
| 2,695,538 A | * | 11/1954 | Parker | 72/217 |
| 2,811,064 A | * | 10/1957 | Peterson | 72/217 |
| 2,864,272 A | * | 12/1958 | Swanson | 72/459 |
| 3,194,038 A | * | 7/1965 | Small et al. | 72/459 |
| 4,379,399 A | | 4/1983 | Kowal | |
| 4,379,400 A | | 4/1983 | Schwarz | |
| 4,380,922 A | | 4/1983 | Kowal | |
| 4,389,872 A | | 6/1983 | Kowal | |
| 4,389,873 A | | 6/1983 | Schwarz et al. | |
| 4,403,496 A | | 9/1983 | Kowal | |
| 4,424,699 A | | 1/1984 | Peppers | |

OTHER PUBLICATIONS

Harbor Freight Tools Catalog, p. 13.
Harbor Freight Tools webpage located at http:www.harbor-freight.com.

* cited by examiner

*Primary Examiner*—David Jones
(74) *Attorney, Agent, or Firm*—Watts, Hoffman, Fisher & Heinke Co., L.P.A.

(57) ABSTRACT

A tube bender for bending tubes of different diameters selectively and one at a time is disclosed. The bender has a pair of pivotally connected handles respectively connected to a form wheel and a form shoe. The wheel has a plurality of tube engagement grooves, the grooves each being generally arcuate in cross section in both axial and orthogonal planes of coss section. The shoe includes a plurality of grooves of arcuate cross section in an axial plane. Each of the shoe grooves is complemental with a different and associated one of the wheel grooves. A tube holder is adjustably positioned in fixed relationship with the wheel when a tubular work piece is engaging one of the grooves in a bending operation. The radii of each of the arcuate wheel groove cross sections is different than the radii of each other corresponding wheel groove cross sections in both the axial and the orthogonal planes

11 Claims, 3 Drawing Sheets

TUBE BENDER

FIELD OF THE INVENTION

This invention relates to tube benders and more particularly to tube benders capable of effecting bends in tubing of differing diameters.

BACKGROUND OF THE INVENTION

For many years, electricians have been using tube benders to effect bends in electrical conduit. Similarly plumbers and other craftsmen have used tube benders to produce bends in tubes for a variety of applications. A typical tube bender has a form wheel which is arcuate in cross section both in an imaginary plane including an axis about which a tubular work piece is bent and in cross section in a plane orthogonal to the axial plane. The form wheel is secured to a handle while a form shoe having complemental surfaces is secured to a second handle and the handles are pivotally connected together. A hook arrangement is provided to retain a work piece in appropriate orientation with a groove in the wheel as a bending operation is effected by relatively rotating the handles such that the form shoe orbits around the wheel groove.

There have been proposals for form wheels with sets of grooves which have different of arcuate surfaces in axial cross section. A shortcoming of these has been that the radii of groove curvature about the wheel axis is a constant such that the radii for smaller tube bends are excessively large. Indeed because the prior hook arrangements are uniformly spaced from the wheel axis the radii of bends in smaller diameter tubes are actually greater than those of larger diameter tubes. Moreover, when bends have been made to an extent measured by a tool mounted protractor, the true angle of a bend has only been accurate for one tube diameter. Thus if a tool gives an accurate indication of a 90 degree bend in a large diameter tool, bends in smaller tubes, producing the same measurement will be less than 90 degrees.

With tube benders it is desirable to have handles of different lengths so that a bending operation can be effected by an operator gripping the handles without either grip being interfered with by the other handle. There have been tube benders in which this is accomplished by having handles which are offset and of different length but the longer handle has been connected to the form wheel with a result that the forming leverage has not been maximized.

Accordingly, it would be desirable to provide a tool for bending tubing to a range of bend radii especially one which is especially suited for bending copper tubing of a range of diameters.

SUMMARY OF THE INVENTION

With the bender of the present invention, a pair of handles of differing length are pivotally connected together by a link. A form wheel is secured to the shorter of the handles. The form wheel has three grooves of differing sizes. That is there is a) a large groove which of the three has the largest radius of curvature in both an axial plane and a plane normal to the axis, b) a second groove of intermediate size with a radius in the axial plane that is shorter than the large groove and c) a smaller third groove. Similarly the radii of curvature of the three grooves are large, medium and small. The three sized grooves are provided so that each groove is designed to accommodate tubing of a standard size such as ½, ⅜, and ¼ inch diameters.

A form shoe is secured to the other and the longer of the handles. The form shoe has three sizes of grooves that are arcuately curved in the same axial plane of cross section as the wheel grooves. In planes normal to the wheel axis the shoe grooves are straight. The shoe grooves are complemental in axial cross section with the wheel grooves and radially aligned such that as the handles are rotated about the pivot, a work piece is engaged and substantially surrounded by the complemental pair of the grooves of the appropriate and matched size.

A work piece holder is provided to retain a work piece in an associated wheel groove and resist forces applied by the shoe as the shoe orbits the wheel. Unlike prior art holders with the holder of the tool of the present invention that part of the hook surface which resists binding forces applied to a smaller tube is closer to the axis of the form wheel then those parts which resist bending forces of larger diameter tubes. While a hook with stepped tube engagement parts will produce small, medium and large radii bends, the preferred and disclosed hook is shiftable to a selected one of three locations, each spaced from the wheel axis in an amount appropriate for bending of a tube in an associated one of the wheel grooves. The holder and the wheel handle have a coacting tongue and groove arrangement for registering the holder selectively and one at a time in a selected and appropriate one of its three positions. A stepped and preferred hook arrangement results in consistent bonds of appropriate radii when measured on a tube mounted protractor.

Accordingly the objects of this invention are to provide a novel and improved tube bender suitable for use with tubing of differing diameters and a process of bending tubing.

DETAILED DESCRIPTION OF THE PREFERRED EMBODIMENT

Figures 1, 2:
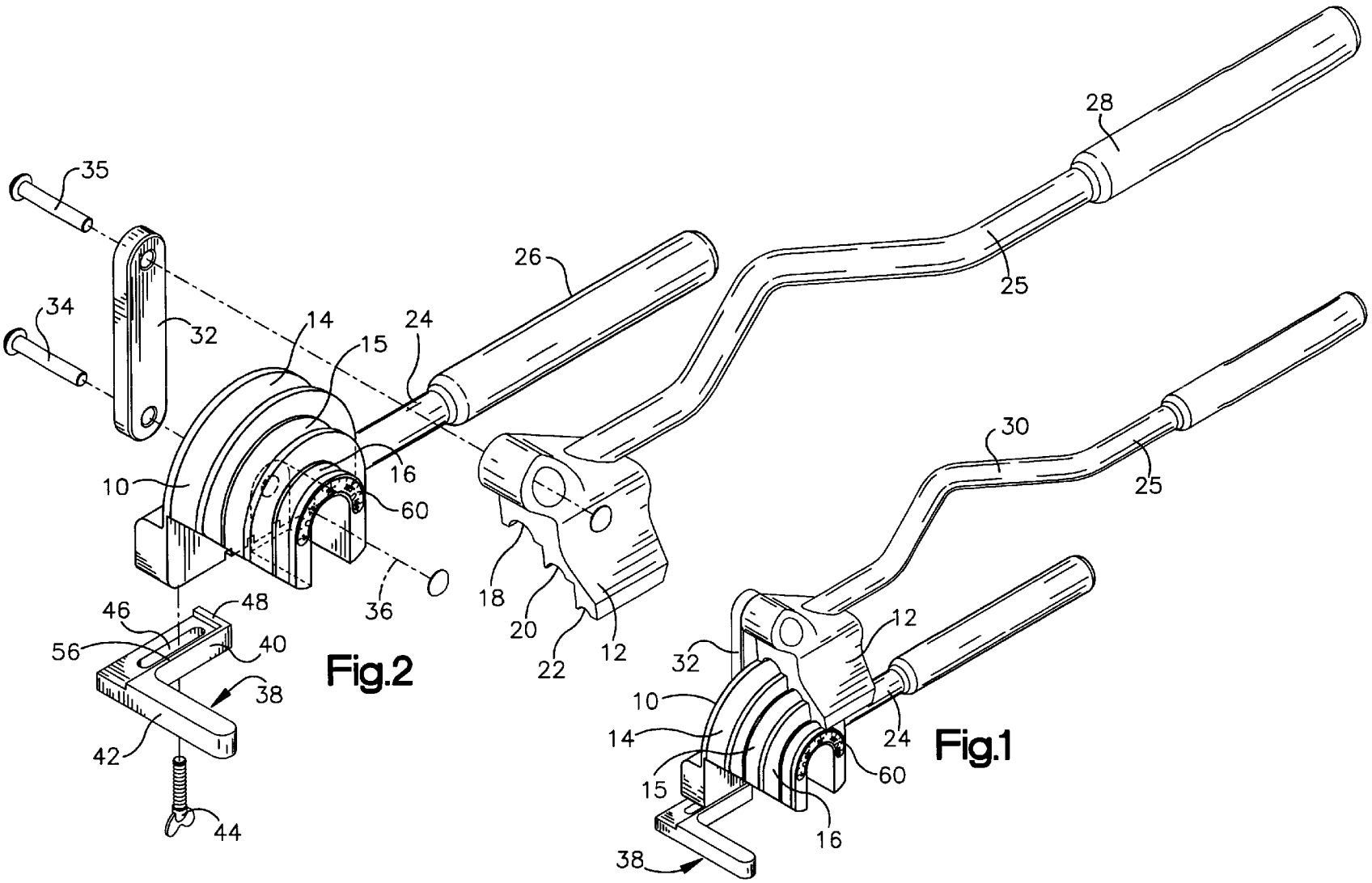
FIG. 1 is a perspective view of the tool of the present invention.
FIG. 2 is an exploded view of the tool of FIG. 1.
Figure 3:
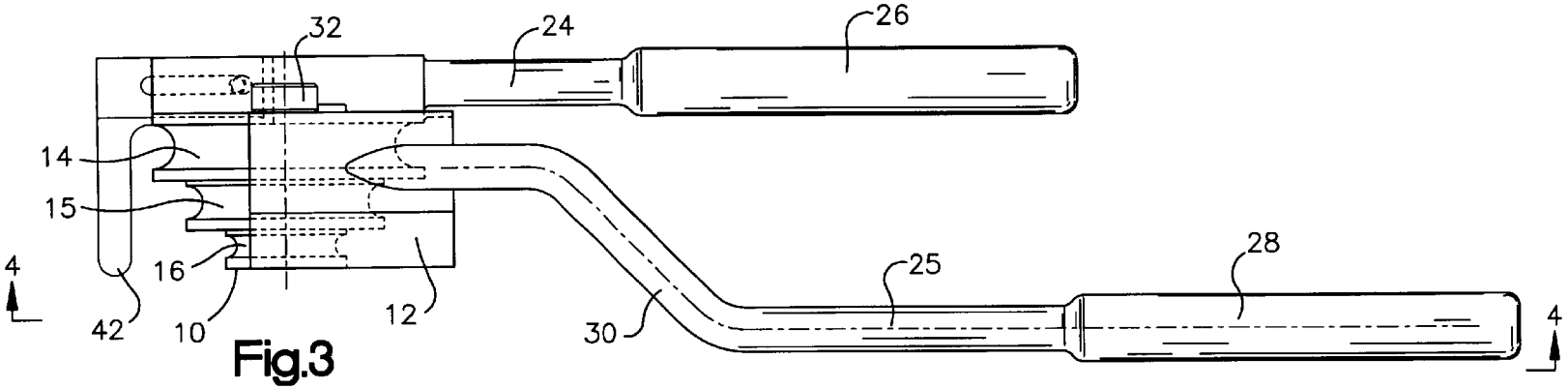
FIG. 3 is a plan view of the tool of FIG. 1.

Referring to the drawings a form wheel is shown generally at 10. A coacting form shoe is shown generally at 12. The wheel has large, intermediate and small peripheral grooves 14, 15, 16. The shoe has complemental large, intermediate and small grooves 18, 20, 22. Thus, the wheel and shoe are complementally stepped in an axial plane of cross section.

Wheel and shoe handles 24, 25 are respectively fixed to the wheel and shoe 10, 12. The handles respectively include handle grips, 26, 28. The shoe handle 25 is of greater length than the wheel handle 24 such that the shoe handle 28 is spaced further from the wheel and the shoe than the wheel handle 26 so that an operator's hands do not find interference when the grips are grasped and manipulated. To further avoid interference the shoe handle 25 includes an offset portion 30.

Figure 5:
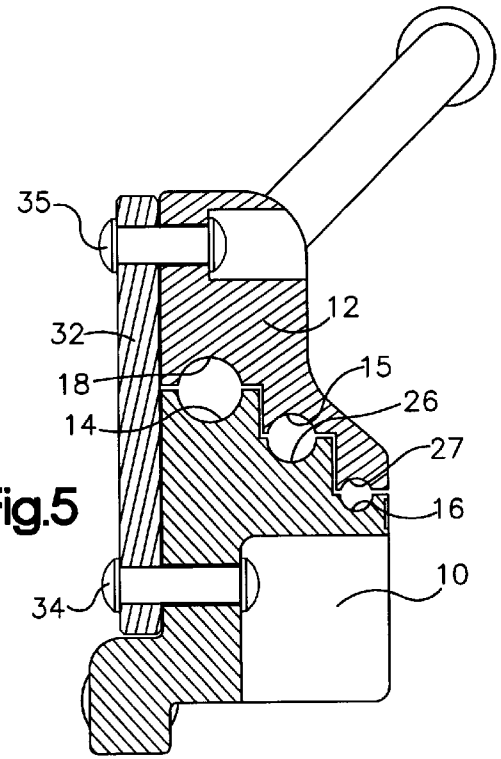
FIG. 5 is a sectional view on an enlarged scale of the tool as seen from the plane indicated by the line 5—5 of FIG. 4; and, FIG. 6 is an enlarged fragmentary side view showing the shoe in solid lines in a position wherein a bending operation is about to be effected and in phantom lines the position of the shoe upon completion of a 180 degree bend.

A link 32 is provided. Pins 34, 35 respectively connect the link to the wheel and shoe as is best shown in FIG. 2. As is best seen in FIG. 2, the wheel grooves 14, 15, 16 are arcuately curved about an axis 36 which is also the axis of the pin 34. The grooves 14, 15, 16 are also arcuately curved in an axial plane located by the axis 36. The grooves 18, 20, 22 of the shoe 12 are also arcuately curved in the axial plane but straight in planes normal to the axial plane. Thus as best seen in FIG. 5 when the shoe and wheel are brought into mating relationships the two large intermediate and small grooves are complementally arranged to provide holes of circular cross section, each sized for a standard size of metal tubing such as ½, ⅜ and ¼ inch tubing.

An L shaped tube holder 38 is provided. The holder 38 includes a mounting arm 40 and an orthogonal work piece engagement arm 42. A thumb screw 44 extends through a slot 46 in the mounting arm 40 and threads into the wheel 10 to secure the holder 38 to the wheel 10. The holder 40 is selectively positionable for large, intermediate and small tubes. In order appropriately to locate the holder 38, the mounting arm 40 includes a tongue 48 which selectively engages one of large, intermediate and small size grooves 50, 52, 54 formed in the base of the wheel 10. The mounting arm 40 also includes a side wall 56 which engages a face of the wheel 10 to assist in location of the holder.

Operation

Figure 4:
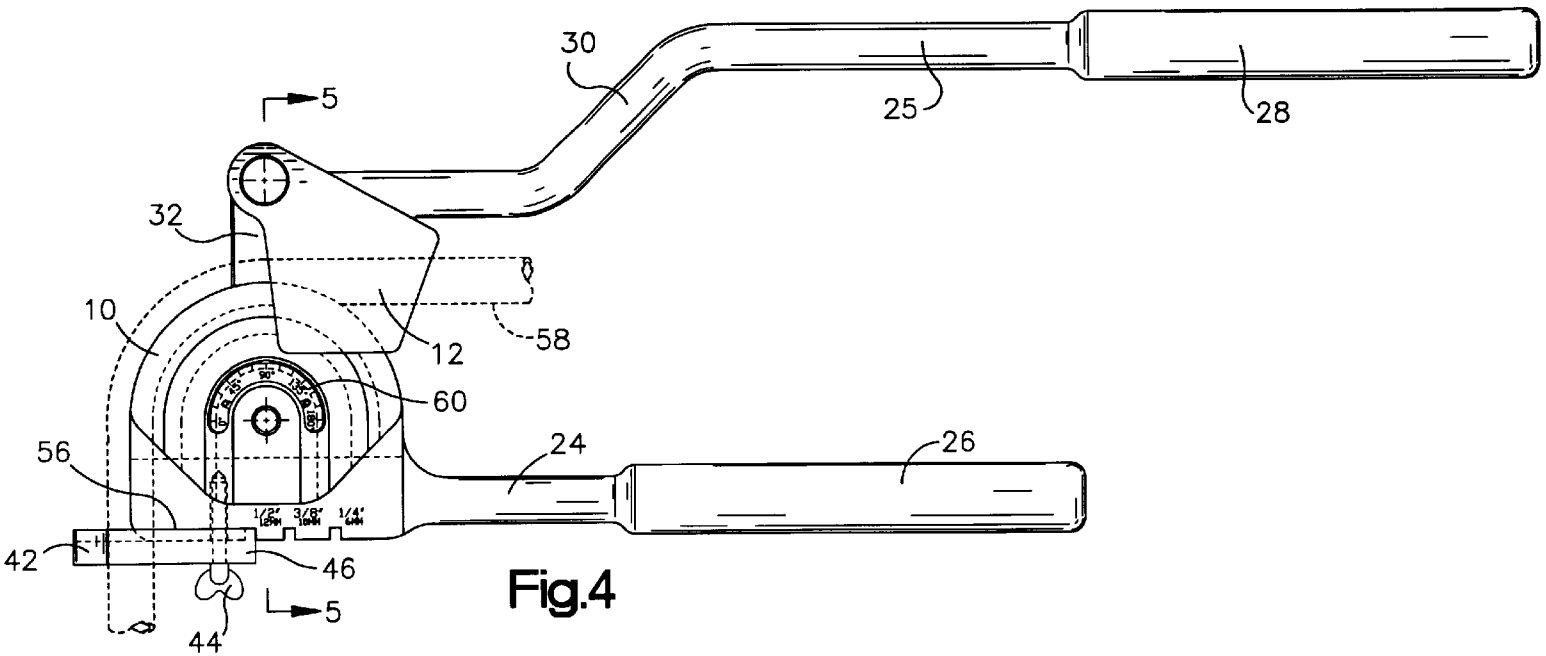
FIG. 4 is a side elevational view of the tool as seen from the planes indicated by the lines 4—4 of FIG. 3.
Figure 6:
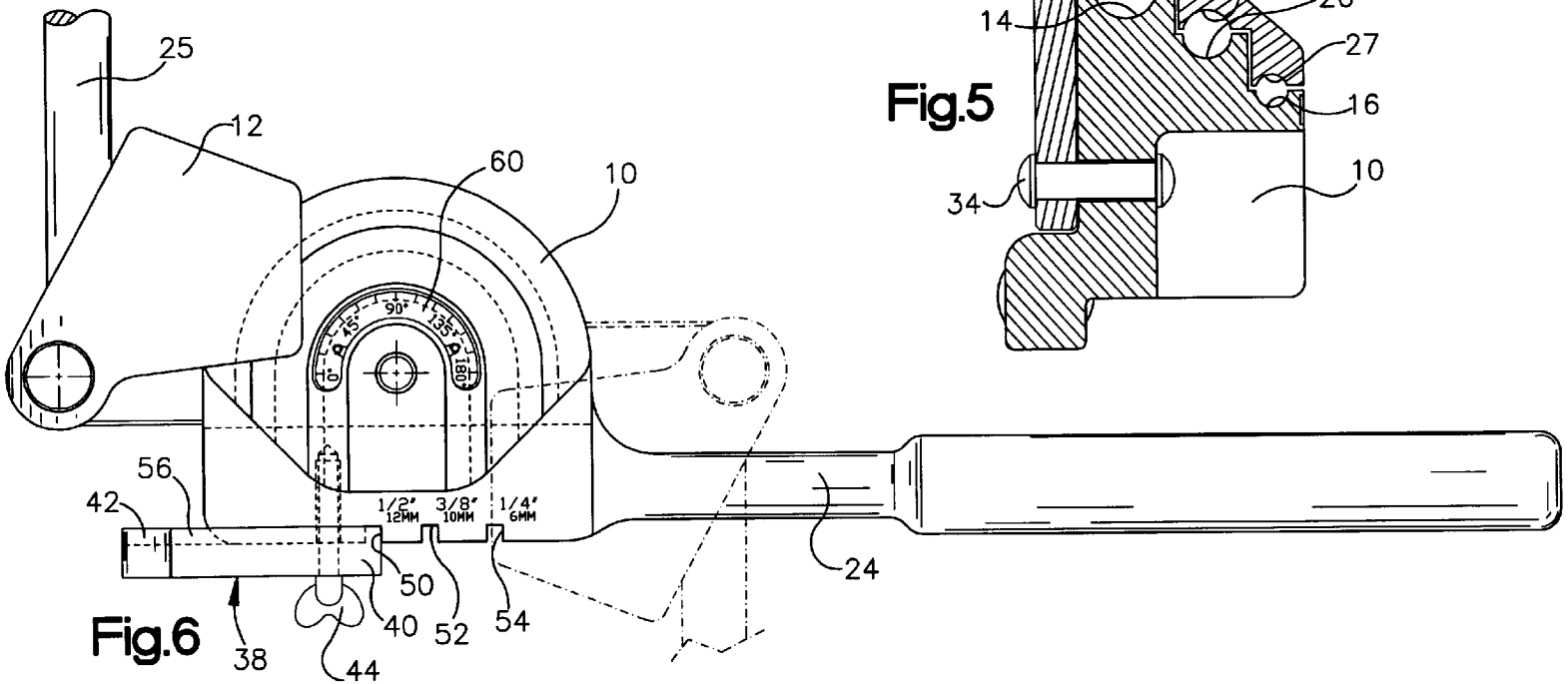

In operation the tube holder 38 is positioned for holding a selected one of the three diameters of tubing. Assuming a large diameter tube is to be bent, the holder is positioned as shown in FIGS. 4 and 6. The handle 25 is rotated relative to the handle 24 to a tube insertion position extending opposite the handle 24 to provide clearance for inserting a work piece 58. Assuming a large sized work piece, the work piece is positioned in an orientation which is vertical when the tool is positioned as shown in FIGS. 4 and 6. The work piece is placed in engagement when the large sized wheel groove 14 and the engagement arm 42. The handle 25 is now moved to the solid line, tube engagement position of FIG. 6 as the bending operation is commenced and the large sized shoe groove 18 is brought into mating orientation such that each mating pair of grooves produces an opening that is circular in cross section to circumscribe tubular work pieces as shown in FIG. 5. The handle grips 26, 28 are manipulated to orbit the shoe about the wheel until a desired amount of bending has been accomplished be it 90 degrees as shown in FIGS. 1 and 4 or 180 degrees as shown in phantom in FIG. 6. A protractor 60 is provided to assist an operator in obtaining a bend of a desired angular extent.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. A tube bender comprising:

a) a pair of elongate handles pivotally connected near respective handle ends;

b) each of the handles having a grip portion near an opposite end;

c) the handles being of different length such that the handles are offset effort to avoid interference with one another in a bending operation;

d) a form wheel secured to one of the handles near the pivot;

e) a form shoe connected to the other of the handles for coaction with the wheel in tube bending operations;

f) the wheel and shoe being complementally stepped axially with each complemental step including a coacting pair of grooves of arcuate cross section for coactively bending tubes in bending operations;

g) each coacting pair being of radial spacing from a wheel axis different than the radial spacing of each other pair of grooves;

h) a holder connected to the one handle for positioning work pieces each in a selected appropriately sized wheel groove during a bending operation;

i) the holder and said one handle including a tongue and groove arrangement for locating the holder in one of a plurality of a plurality of positions selectively and one at a time; and j) there being a like number of holder positions and groove pairs with each position for use with a different and an associated on of the groove pairs.

2. The bender of claim 1, wherein a link provides the pivotal connection between the handles and the link is pivotally connected to each of the wheel and the shoe.

3. The bender of claim 1, wherein each of the grooves is semicircular in a cross sectional plane including a wheel axis.

4. The bender of claim 1, wherein the wheel grooves are arcuate in planes orthogonal to the wheel axis and the shoe grooves are straight in such orthogonal planes.

5. A process of bending a set of tubular work pieces wherein the set includes tubes of at least two diameters;

a) placing a first tube in engagement with surfaces of an arcuately curved groove in a form wheel;

b) placing a tube holder in tube retention orientation with the first tube;

c) applying bending forces to the first tube with a form shoe and thereby forming a first arcuate bend in the first tube;

d) placing a second tube in engagement with surfaces of another arcuately curved groove in the form wheel;

e) placing [the] said tube holder in a different tube retention orientation with the second tube;

f) applying bending forces to the second tube with the form shoe and thereby forming a second arcuate bend in the second tube; and, g) the radii of the first and second tube bends and the diameters of the tubes being different.

6. The process of claim 5 further including moving the tool holder relative to the wheel from the retention orientation for the first tube to the retention orientation for the second tube.

7. The process of claim 5 wherein at least one of the bends is about 180 degrees in extent.

8. The process of claim 5 wherein the bend formed in the tube having the smaller diameter is of a smaller radius then the bend in the other of the tubes.

9. A tube bender comprising:

a) a form wheel having a plurality of tube engagement grooves arcuately curved about a bending axis;

b) a form shoe having grooves which are complemental with the wheel grooves to provide complemental groove pairs;

c) a tube holder connected to the wheel for engaging tubular work pieces during a tube bending operation;

d) said holder including a plurality of tube engagement surface parts, each part being aligned with an associated pair of complemental grooves when the tool is in use; and, e) at least one of the surface parts being spaced from the bending axis a certain distance during a bending operation in the groove pair associated with the at least one part and another of the parts being spaced a different distance from another and associated groove pair during a tube bending operation in the another groove pair.

10. The bender of claim 9 wherein there are three wheel grooves each of a different radius about the axis than the other wheel grooves and there are three holder parts each associate with a different wheel groove and each of the parts when in use being at a spacing from the axis different than the spacing of the other parts when the other parts are in use.

11. A tube bender for bending selectively and one at a time tubes of different diameters comprising;

a) a pair of handles pivotally connected together near respective ends of the handles;

b) each of the handles having a grip portion near another handle end spaced from the pivot;

c) a form wheel connected to one of the handles near the pivot;

d) the wheel having a plurality of tube engagement grooves, the grooves each being generally arcuate in cross section in both axial and orthogonal planes of cross section;

e) a tube holder positionable selectively and one at a time in each of a plurality of tube bending engagement positions each for a different tube size, the holder when in each of the bending engagement positions being in fixed relationship with the wheel when a tubular work piece is engaging one of the grooves in a bending operation;

f) a form shoe secured to the other of the handles and positioned to apply bending forces to such a work piece as the handles are pivoted when the grip portions are moved toward one another in a bending operation;

g) the shoe including a plurality of grooves of arcuate cross section, each of the shoe grooves being complemental with a different and associated one of the wheel grooves; and, h) the radii of each of the arcuate wheel groove cross sections being different than the radii of each other corresponding wheel groove cross section in both the axial and the orthogonal planes; and, i) the holder and said one handle being interconnected, the interconnection including a tongue and groove arrangement for locating the holder in each of its bending engagement positions selectively and one at a time.

* * * * *